US011122860B2

(12) United States Patent
Lilley

(10) Patent No.: US 11,122,860 B2
(45) Date of Patent: Sep. 21, 2021

(54) ITEM OF FOOTWEAR

(71) Applicant: FITFLOP LIMITED, London (GB)

(72) Inventor: Kim Lilley, London (GB)

(73) Assignee: FITFLOP LIMITED

( * ) Notice: Subject to any disclaimer, the term of this patent is extended or adjusted under 35 U.S.C. 154(b) by 281 days.

(21) Appl. No.: 15/778,003

(22) PCT Filed: Nov. 22, 2016

(86) PCT No.: PCT/GB2016/053626
§ 371 (c)(1),
(2) Date: May 22, 2018

(87) PCT Pub. No.: WO2017/089751
PCT Pub. Date: Jun. 1, 2017

(65) Prior Publication Data

US 2018/0368519 A1 Dec. 27, 2018

(30) Foreign Application Priority Data

Nov. 23, 2015 (GB) ..... 1520625

(51) Int. Cl.
*A43B 13/18* (2006.01)
*A43B 13/20* (2006.01)
(Continued)

(52) U.S. Cl.
CPC ..... *A43B 13/186* (2013.01); *A43B 13/04* (2013.01); *A43B 13/14* (2013.01); *A43B 13/20* (2013.01); *A43B 19/00* (2013.01); *A43B 3/128* (2013.01)

(58) Field of Classification Search
CPC ... A43B 13/186; A43B 13/223; A43B 13/187; A43B 13/188; A43B 13/04; A43B 13/14;
(Continued)

(56) References Cited

U.S. PATENT DOCUMENTS 1,676,415 A * 7/1928 Saperston ..... A43B 7/142 36/146
1,785,410 A * 12/1930 Gilkerson ..... A43B 13/187 36/17 R
(Continued)

FOREIGN PATENT DOCUMENTS

FR 2519521 A1 7/1983
GB 2513886 A1 11/2014
(Continued)

*Primary Examiner* — Heather Mangine
(74) *Attorney, Agent, or Firm* — Luedeka Neely Group, PC

(57) ABSTRACT

The invention relates to a sole for an item of footwear, and an item of footwear comprising the sole. The item of footwear includes a sole having a layer of material defining a frontal/toe region, a mid-foot region and a heel region, wherein the layer has a first major surface for facing the foot of a wearer and a second major surface opposite the first; and a securing means for securing the item of footwear to a foot of a wearer, wherein: the material has the same composition in each of the frontal/toe region, the mid-foot region and the heel region; the frontal/toe region and the mid-foot region have formed therein a plurality of cavities such that the average density of the frontal/toe region and the mid-foot region is less than the heel region.

15 Claims, 5 Drawing Sheets

(51) Int. Cl.
*A43B 13/14* (2006.01)
*A43B 13/04* (2006.01)
*A43B 19/00* (2006.01)
*A43B 3/12* (2006.01)

(58) Field of Classification Search
CPC ..... A43B 13/20; A43B 13/146; A43B 7/1485; A43B 7/1425
USPC ..... 36/29
See application file for complete search history.

(56) References Cited

U.S. PATENT DOCUMENTS 2,426,735 A * 9/1947 Hiss ..... A43B 7/1425 36/146
2,885,797 A * 5/1959 Chrencik ..... A43B 13/186 36/91
3,568,340 A * 3/1971 Gardner ..... A43B 13/04 36/32 R
3,608,215 A 9/1971 Fukuoka
3,828,792 A * 8/1974 Valenta ..... A43B 7/1425 36/178
4,043,058 A * 8/1977 Hollister ..... A43B 5/00 36/102
4,223,456 A * 9/1980 Cohen ..... A43B 7/08 36/29
4,364,188 A * 12/1982 Turner ..... A43B 5/06 36/129
4,439,936 A 4/1984 Clarke et al.
4,494,322 A * 1/1985 Klagmann ..... A43B 13/186 36/28
4,616,431 A * 10/1986 Dassler ..... A43B 13/181 36/28
4,680,875 A * 7/1987 Danieli ..... A43B 13/181 36/25 R
5,014,706 A * 5/1991 Philipp ..... A43B 7/141 36/140
5,611,153 A * 3/1997 Fisher ..... A43B 7/14 36/173
6,065,229 A * 5/2000 Wahrheit ..... A43B 13/00 36/25 R
6,138,383 A * 10/2000 Steinke ..... A43B 7/1425 36/141
6,176,025 B1 * 1/2001 Patterson ..... A43B 5/001 36/28
6,425,194 B1 * 7/2002 Brie ..... A43B 7/141 264/220
D572,887 S * 7/2008 Byrne ..... A43B 3/26 D2/961
7,703,219 B2 * 4/2010 Beck ..... A43B 17/08 36/147
7,707,746 B2 * 5/2010 Dean ..... A43B 13/181 36/35 B
9,380,828 B2 * 7/2016 Lee ..... A43B 7/144
2005/0126038 A1 6/2005 Skaja et al.
2006/0137221 A1 * 6/2006 Dojan ..... A43B 13/20 36/29
2006/0156579 A1 * 7/2006 Hoffer ..... A43B 1/0009 36/28
2009/0113767 A1 * 5/2009 Lee ..... A43B 1/0045 36/3 B
2011/0016750 A1 * 1/2011 Crowley, II ..... A43B 3/0052 36/103
2011/0179672 A1 * 7/2011 Cheng ..... A43B 7/141 36/71
2012/0180336 A1 * 7/2012 Sullivan ..... A43B 7/144 36/31
2013/0125421 A1 5/2013 Stegmaier
2014/0196308 A1 * 7/2014 Baratta ..... A43B 13/184 36/29
2015/0101215 A1 * 4/2015 Henderson ..... A43B 13/125 36/103
2015/0282558 A1 * 10/2015 Rawls-Meehan .... A43B 3/0057 36/31
2016/0037858 A1 * 2/2016 Foxen ..... A43B 13/125 36/103
2016/0037860 A1 2/2016 Holt
2016/0100652 A1 * 4/2016 Bann ..... A43B 7/141 36/30 R
2016/0345665 A1 * 12/2016 Kohatsu ..... A43B 13/186
2016/0345666 A1 * 12/2016 Kohatsu ..... A43B 7/144
2017/0238652 A1 * 8/2017 Langvin ..... A43B 13/04
2017/0332727 A1 * 11/2017 Beck ..... A43B 7/146
2017/0356517 A1 * 12/2017 Betteridge ..... B32B 25/042
2018/0035751 A1 * 2/2018 Rehagen ..... A43B 13/187
2018/0338567 A1 * 11/2018 Xanthos ..... A43B 1/0009
2018/0368519 A1 * 12/2018 Lilley ..... A43B 13/186
2019/0082781 A1 * 3/2019 Iuchi ..... A43B 13/04
2019/0313736 A1 * 10/2019 Canfield ..... A43B 17/08

FOREIGN PATENT DOCUMENTS

JP 2001008703 A1 1/2001
JP 2005287608 A1 10/2005

* cited by examiner

ITEM OF FOOTWEAR

RELATED APPLICATION

This application is a § 371 National Stage Application of PCT Application No.: PCT/GB2016/053626, filed Nov. 22, 2016.

The invention relates to a sole for an item of footwear, and an item of footwear comprising the sole. Preferred embodiments of the item of footwear can provide comfort for the wearer.

BACKGROUND OF THE INVENTION

It is known from WO 2008/132478 to provide an item of footwear 1 having a sole 2 that includes the sole an upper-sole 2A, a mid-sole 2B and a lower-sole 2C. The sole 2 is notionally divided into three distinct regions, as can be seen in the cross-section of FIG. 1: a frontal/toe region 4; a mid-foot region 5; and a heel region 6. The three regions of the midsole are formed from materials of different densities, with the mid-sole region 5 being provided from a material of least density. Thus the prior art sole is arranged such that application of a wearer's weight, during walking, causes instability in the sole which requires balance correction by a user.

BRIEF SUMMARY OF THE INVENTION

The inventors of the present invention have discovered that such an arrangement of densities can provide greater comfort for the wearer than if the sole were a constant density throughout.

However, the sole is complicated to manufacture owing to the need to provide three distinct materials. Accordingly, a simpler alternative is required, which requires less material.

There is therefore presented an item of footwear as defined by the following claims.

BRIEF DESCRIPTION OF THE DRAWINGS

For a better understanding of the invention and to show how the same may be put into effect, reference will now be made, by way of example only, to the accompanying drawings in which.

DETAILED DESCRIPTION OF THE INVENTION

Figure 1:
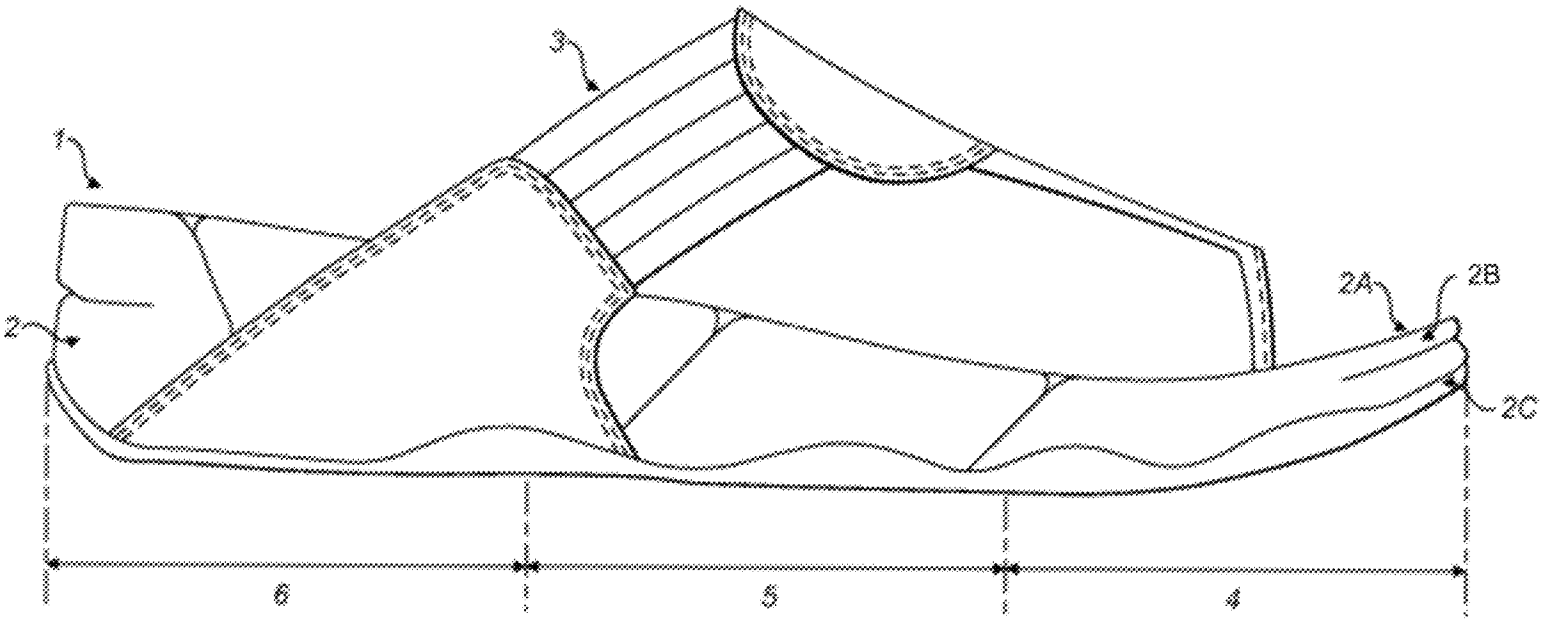
FIG. 1 Prior Art
FIG. 1 schematically depicts the notional division of an item of footwear into frontal/toe, mid-foot, and heel regions.
Figure 2:
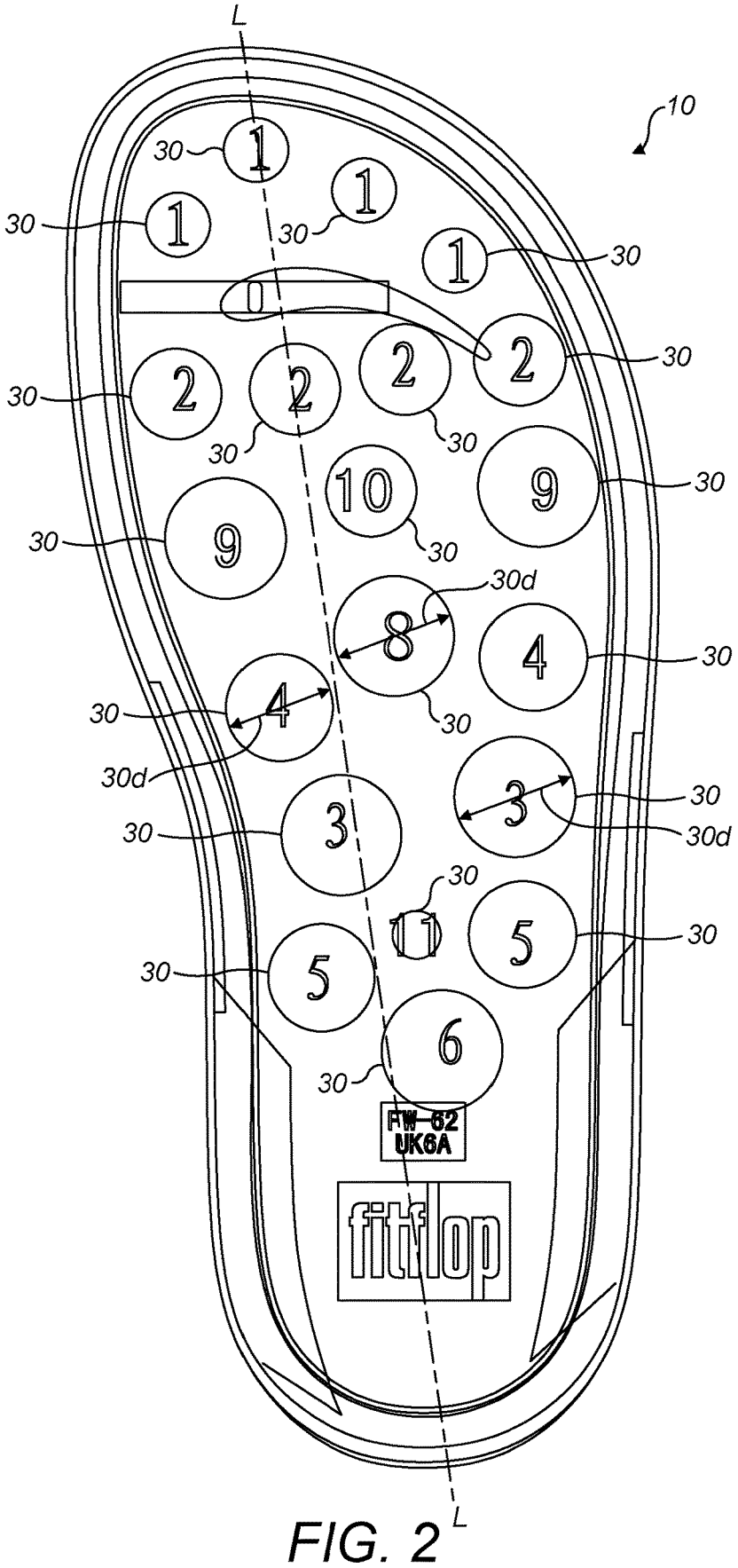
FIG. 2 shows a plan view of a sole 10 for use in an item of footwear in accordance with the present invention.
Figure 3:
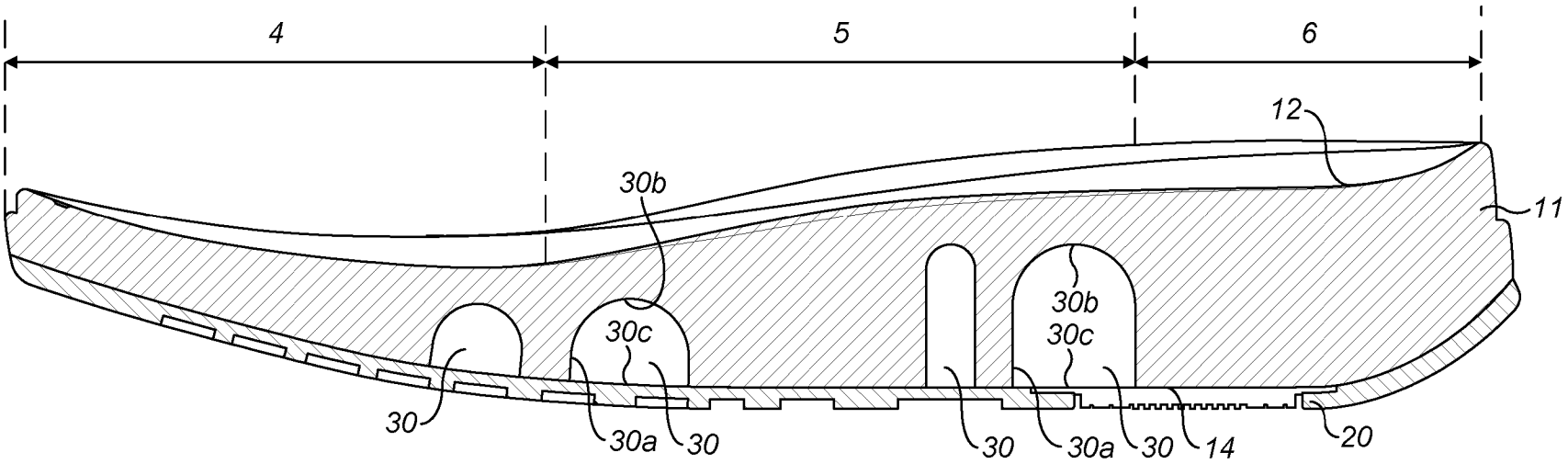
FIG. 3 shows a cross-section through the sole 10 of FIG. 1 in a longitudinal direction L-L.
Figure 4A:
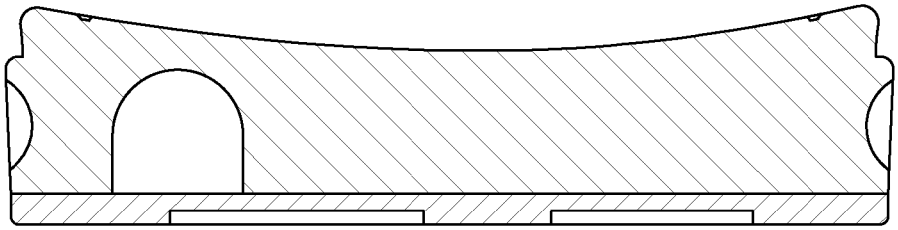
FIGS. 4A to 4F show cross-sections through the sole 10 of FIG. 1 in a transverse direction.
Figure 4B:
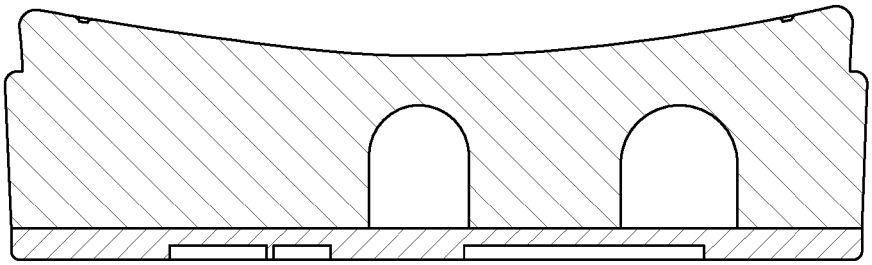
Figure 4C:
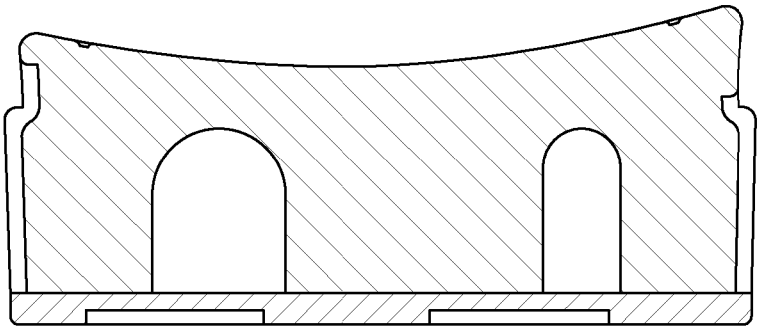
Figure 4D:
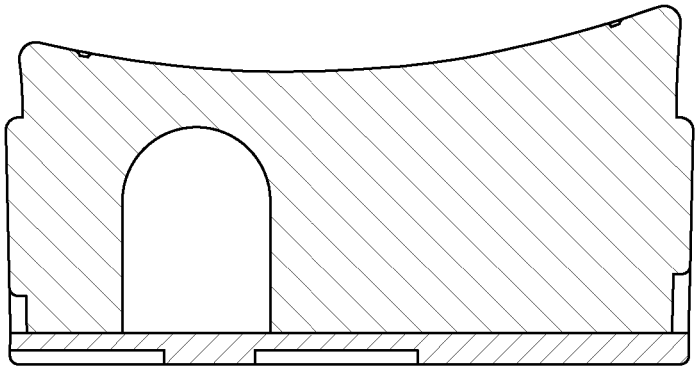
Figure 4E:
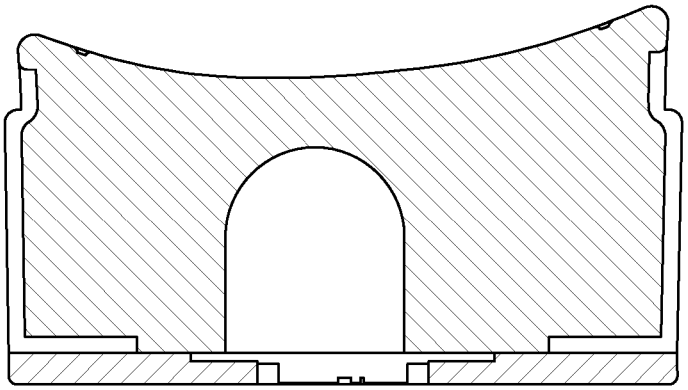
Figure 4F:
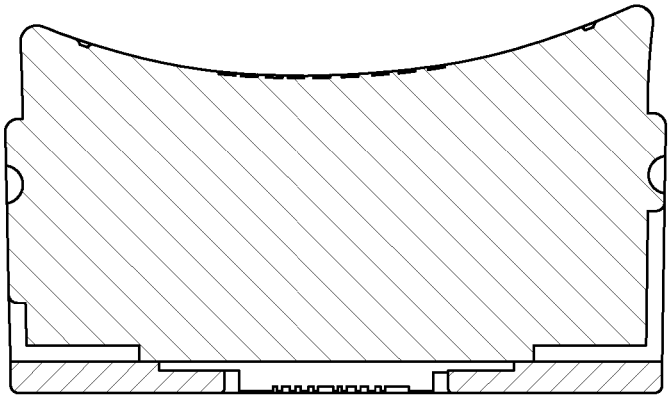

A first embodiment of an item of footwear comprises a sole 10 and a securing means (for example, strap such as reference 3 in FIG. 1, or the upper if the item of footwear is a closed shoe) for securing the item of footwear to a foot of a wearer such that a first surface 12 of the sole 10 contacts the foot.

The sole 10 has a layer 11 of material, preferably forming the major impact absorbing part of the sole 10. Preferably, the layer 11 has a greater depth in the heel region 6 than in the frontal/toe region.

Preferably, the layer 11 has a thickness at its narrowest part of at least 14 mm. Preferably, the layer 11 has a thickness at its thickest part of at most 35 mm.

The layer 11 preferably has a first major surface 12 (the upper surface) for facing the foot of a wearer and a second major surface 14 (the lower surface) opposite the first. The layer 11 of material may form the midsole of the sole 10.

Preferably, an outsole 20 is provided on the second major surface 14 of the midsole. The outsole 20 provides a surface for contacting the ground, and may be provided with one or more ridges or grooves for providing grip. The outsole 20 is preferably moulded separately from the rest of the sole and then bonded to the layer/midsole 11.

Alternatively, a plurality of separate outsole sections may be provided, with each outsole section covering one or more cavity/cavities 30.

Since it contacts the ground, the outsole(s) 20 is formed by a material having good wear characteristics. The outsole 20 typically has a constant thickness of about 4.5 mm.

Preferably, the outsole 20 comprises or is formed from rubber.

Preferably, a topsock (not shown) is also provided. The topsock may be bonded to the layer/midsole 11 on the first major surface 12. The topsock is arranged to contact a foot of a wearer and may be textured to provide a gripping surface for the foot of the wearer. The topsock could, for example, be a coating applied to an upper surface of the layer/midsole 11, e.g. a textile coating, or a layer of fabric bonded to the upper surface of the layer/midsole 11. In alternative items of footwear, such as in a closed shoe an insole could be used in place of the topsock.

The layer 11 may be notionally divided into a frontal/toe region 4, a mid-foot region 5 and a heel region 6. The material has the same composition in each of the frontal/toe region 4, the mid-foot region 5 and the heel region 6. That is, the properties of the material, such as density and compressive resistance are constant throughout the material.

Preferably, the layer 11 comprises or is formed from EVA (Ethylene Vinyl Acetate).

However, the inventors have realised that although the density of the material is constant throughout the entire sole, the material can be removed in certain locations such that the average density over a particular region of the sole can be reduced as compared with the density of a solid region of the material (by average density, the mean density is meant).

Preferably, the frontal/toe region 4 has formed therein a plurality of cavities 30 such that the average density of the frontal/toe region 4 is less than the heel region 6.

Similarly, the mid-foot region 5 has formed therein a plurality of cavities such that the average density of the mid-foot region 5 is less than the heel region 6.

It is also preferred that the average density of the mid-foot region 5 is lower than the average density of the frontal/toe region 4.

It has been discovered that an advantageous shape for the cavities is generally cylindrical 30*a*. Furthermore, providing a domed end 30*b* to the cylindrical cavity has been found to be advantageous because it can prevent the end of the cylinder collapsing under the weight of the wearer.

The cavities 30 may be entirely encapsulated within the layer 11. However it is preferable that the cavities 30 extend to openings 30*c* on the second major surface 14 of the layer 11.

Most preferably, the cavities 30 do not extend to the first major surface 12. In this way, a predetermined depth of material can be retained below the first major surface 12 of the layer 11. Preferably, a depth of 5 mm from the first major surface 12 does not include any cavities 30.

When an outsole 20 is provided on the second major surface 14 of the layer 11, it is preferred that this closes the openings 30*c* of the cavities 30.

In preferred embodiments of an item of footwear according to the present invention, the frontal/toe region 4 extends over the forwardmost 15% to 24% of the length of the sole, preferably around 18%, the mid-foot region 5 extends over the middle 37% to 53% of the length of the sole, preferably over the middle 47% to 53% of the length of the sole and most preferably around 50%, and the heel region 6 extends over the rearmost 29% to 39% of the length of the sole, preferably around 32%.

By providing the regions of the layer 11 with different densities, it is possible to provide the effect of a variation in hardness and/or flexibility as between the frontal/toe, mid-foot, and heel regions.

In preferred embodiments, the regions of the layer 11 are such that the heel region has an average hardness of 54 to 60, the mid-foot region 5 has an average hardness of 28 to 35, and the frontal/toe region 4 has an hardness density of 41 to 48 (all values being ASKER C). Preferably, the heel region 6 has an average hardness of 57, the mid-foot 5 region has an average hardness of 31, and the frontal/toe region 4 has an average hardness of 45 (all values being ASKER C).

It is most preferable that the heel region 6 is solid without any cavities 30 formed therein. Thus, the layer 11 will be made of a material having an average hardness of 54 to 60, preferably 57 (all values being ASKER C).

The average hardness of the layer 11 in each region 4, 5, 6 may be measured by taking multiple ASKER C measurements of the first major surface 12 in each region 4, 5, 6. For example, an ASKER C durometer may be used to take a measurement at each location of a regular array of locations on the first major surface 12 of the layer 11, and these averaged (mean) to provide an average hardness value. The spacing for the regular array should be small to provide an accurate reading. For example, 30 mm or less, preferably 5 mm or less.

The widths 30*d* of each of the cavities 30 (measured parallel to the second major surface 14 of the layer 11—i.e. the radius when cylindrical cavities 30 are provided) is preferably in the range 10 mm to 25 mm. If the cavities 30 are wider than this, it has been found that the wearer can feel the presence of the cavities 30. If the cavities 30 are narrower than this, it has been found that the desired comfort is not achieved.

Preferably, the maximum depth of the cavities 30 is in the range 12 mm to 25 mm.

It is preferable that the cavities 30 have a different configuration in the frontal/toe 4 and mid-foot 5 regions. Owing to the generally tapered shape of the sole, the cavities 30 in the frontal/toe region 4 are preferably less deep than the cavities 30 in the mid-foot region 5.

In preferred embodiments, the cavities 30 in the frontal/toe region 4 have smaller widths than the cavities 30 in the mid-foot region 5. This is beneficial because the wearer's foot is more sensitive in the frontal/toe region 4.

If the cavities 30 are provided in a regular array, it has been found that the material can form noticeable ridges between the cavities 30. Therefore, it is preferred to distribute the cavities 30 in an irregular manner. For instance, the cavities 30 may be distributed so as to overlap in the longitudinal direction of the sole (i.e., the direction from the rearmost part of the heel to the frontmost tip of the sole when worn by a user).

Similarly, the cavities 30 may be distributed in the mid-foot region 5 so as to overlap in the transverse direction (the transverse direction being perpendicular to the longitudinal direction).

The invention claimed is:

1. An item of footwear comprising:

a sole having a layer of material defining a frontal/toe region, a mid-foot region and a heel region, wherein the heel region extends over the rearmost 29% to 39% of the sole, wherein the layer of material has a first major surface configured to face a foot of a wearer and a second major surface opposite the first major surface; and a securing means for securing the item of footwear to the foot of the wearer such that a first surface of the sole is configured to contact the foot, wherein:

the layer of material has a uniform composition in each of the frontal/toe region, the mid-foot region and the heel region;

the layer of material has a plurality of cavities formed in the frontal/toe region such that an average density of the frontal/toe region is less than an average density of the heel region;

the layer of material has a plurality of cavities formed in the mid-foot region such that an average density of the mid-foot region is less than the average density of the heel region;

the layer of material is solid and devoid of cavities in an entirety of the heel region; and an outsole is provided adjacent to the second major surface of the layer of material closing the cavities in the layer of material in the frontal toe/region and mid-foot region.

2. The item of footwear of claim 1, wherein the average density of the frontal/toe region is greater than the average density of the mid-foot region.

3. The item of footwear of claim 1, wherein the plurality of cavities in the frontal/toe region and mid-foot region have widths that do not exceed 25 mm.

4. The item of footwear of claim 1, wherein the plurality of cavities in the frontal/toe region and mid-foot region have widths that are at least 10 mm.

5. The item of footwear of claim 1, wherein plurality of cavities in the frontal/toe region and mid-foot region have depths that do not exceed 25 mm.

6. The item of footwear of claim 1, wherein the plurality of cavities in the frontal/toe region and mid-foot region have depths that are at least 12 mm.

7. The item of footwear of claim 1, wherein a portion of the layer of material between the first major surface and the second major surface that is devoid of a plurality of cavities has a minimum thickness of at least 5 mm.

8. The item of footwear of claim 1, wherein the plurality of cavities in the frontal/toe region and mid-foot region are cylindrical.

9. The item of footwear of claim 1, wherein the plurality of cavities in the frontal/toe region and mid-foot region have domed ends.

10. The item of footwear of claim 1, wherein the plurality of cavities in the frontal/toe region and mid-foot region extend to openings on the second major surface of the layer.

11. The item of footwear of claim 1, wherein the plurality of cavities in the frontal/toe region have smaller widths than the plurality of cavities in the mid-foot region.

12. The item of footwear of claim 1, wherein the plurality of cavities in the frontal/toe region and mid-foot region are distributed in an irregular manner.

13. The item of footwear of 1, wherein an average ASKER C hardness of the heel region ranges from 54 to 60.

14. The item of footwear of claim 1, wherein the layer comprises or is formed from ethylene vinyl acetate (EVA).

15. The item of footwear of claim 1, wherein the outsole comprises or is formed from rubber.

* * * * *